United States Patent [19]

Weigl et al.

[11] 3,975,034

[45] Aug. 17, 1976

[54] SAFETY SKI BINDING

[75] Inventors: Erwin Weigl, Brunn am Gebirge; Ernst Rossler, Vienna; Josef Svoboda, Schwechat, all of Austria

[73] Assignee: Gertsch AG, Zug, Switzerland

[22] Filed: July 7, 1975

[21] Appl. No.: 593,840

[30] Foreign Application Priority Data

July 12, 1974 Austria ..... 5806/74

[52] U.S. Cl. ..... 280/618; 280/633

[51] Int. Cl.[2] ..... A63C 9/086

[58] Field of Search ..... 280/11.35 K, 11.35 E, 280/11.35 Q; 24/206 R, 206 B, 272; 403/107

[56] References Cited

UNITED STATES PATENTS

| | | | |
|---|---|---|---|
| 275,303 | 4/1883 | Werneth | 403/107 |
| 1,003,907 | 9/1911 | Hoffman | 24/272 |
| 3,284,092 | 11/1966 | Rumaner | 280/11.35 K |
| 3,798,691 | 3/1974 | Noterman et al. | 280/11.35 E |
| 3,876,218 | 4/1975 | Von Besser | 280/11.35 K |
| 3,888,499 | 6/1975 | Gertsch et al. | 280/11.35 K |

FOREIGN PATENTS OR APPLICATIONS

| | | | |
|---|---|---|---|
| 197,319 | 4/1938 | Switzerland | 280/11.35 Q |

*Primary Examiner*—M. H. Wood, Jr.
*Assistant Examiner*—David M. Mitchell
*Attorney, Agent, or Firm*—Woodhams, Blanchard and Flynn

[57] ABSTRACT

For the heel holder of a safety ski binding having a separable sole plate, there is provided a row of teeth laterally across the sole plate and anchoring means for anchoring a cable extending from said means to the component engaging the heel of the ski boot. Said anchoring means comprises a pair of longitudinally spaced cross members which are connected together and which provide a fulcrum intermediate the ends thereof for engaging said sole plate. Said cable is anchored to said anchoring means on one side of said fulcrum and tooth means are provided on the other side thereof for engaging the teeth on the sole plate. The force of the cable when in operating position with respect to a ski boot holds the tooth firmly in engaging position but with the ski boot removed the anchoring means may be tilted and quickly and easily adjusted to any different desired position. In one embodiment the transversely positioned teeth are on the top of the sole plate and in another embodiment the transversely positioned teeth are on the bottom of the sole plate.

5 Claims, 7 Drawing Figures

FIG. 7
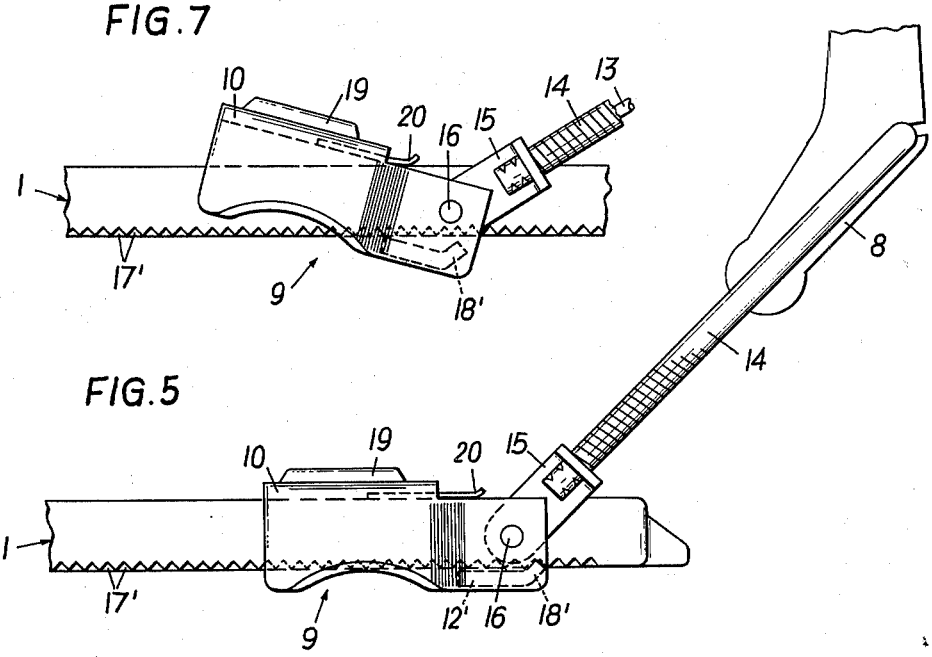
FIG. 5
FIG. 6
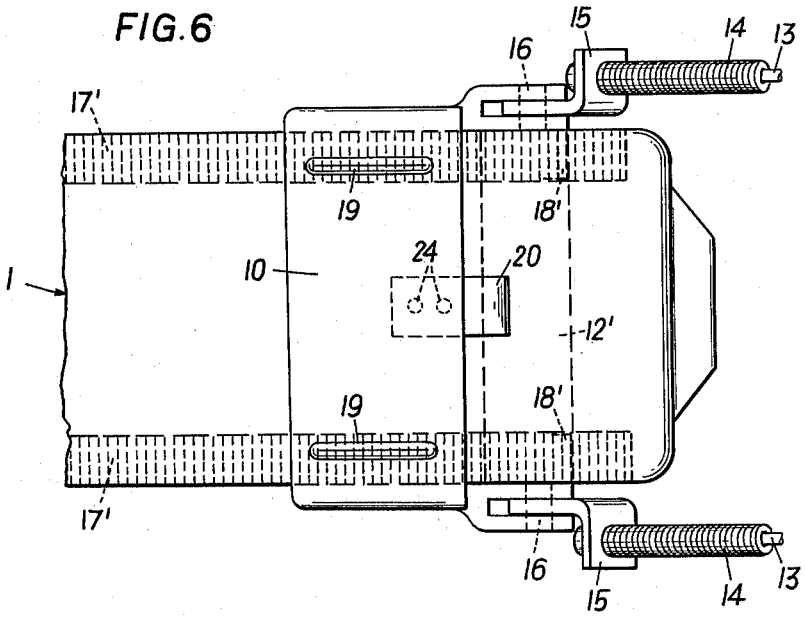

SAFETY SKI BINDING

FIELD OF THE INVENTION

The invention relates to a safety ski binding having a sole plate which is releasably secured on the ski between holding members, which sole plate grips over the ski boot by means of a front support member and a heel holder which can be adjusted in the longitudinal direction of the sole plate.

BACKGROUND OF THE INVENTION

In a known binding of this type, the heel holder is adjustable in the longitudinal direction on the sole plate in order to adjust same to various boot sizes. For this purpose, the part which grips over the heel is connected to the sole plate through a cable whose ends have bent bolts. The bent ends of the bolts are threaded and are screwed laterally into the sole plate. For adjustment, the connection between cable and bolt must on one side be separated by releasing a retaining nut and on the other side the bolt must be screwed out of the sole plate and must be screwed into different openings. This is a very expensive and complicated manipulation. Similar difficulties are created also in bayonet locks or clamp locks. In a different known device (German OS 1 428 979, published Jan. 23, 1969), a guide rail is mounted on the ski, on which guide rail there is guided an elongated slide plate having a front support member and a heel plate which carries a heel holder. Screws are provided to fix this unit onto the guide rail. After loosening these screws, the slide plate can be pulled off the guide rail with the front support member and the heel plate. It is only then possible to adjust the heel plate with respect to the elongated slide plate and in such operation an elevated portion engages one of several openings. Then these two parts, slide plate and heel plate, must be held with respect to one another, until they are again guided into the guide rail. Only then are these two parts held together. In order now to hold the entire unit nonmovably on the guide rail, the screws must again be tightened. This device also is very expensive and complicated in handling.

The purpose of the invention is to overcome these disadvantages and to produce a device, with which an adjustment, namely an adjustment to various sizes of boot soles, can take place in a simple manner and very quickly.

SUMMARY OF THE INVENTION

The objective of the invention is attained by providing the slide member with at least two bars which extend transversely of the longitudinal direction of the ski, which bars rest on opposite surfaces of the sole plate and one of the bars can engage the sole plate and can disengage from same, and a gap is formed between the edges of the bars, which edges are directed toward one another, said gap — assuming a corresponding dimension of width and height of the slide member — being larger than the height of the locking tooth of the slide member. Said locking tooth engages the teeth of the sole plate.

The inventive construction assures a secure holding of the heel and thereby a simple adjustability of the slide member by adjusting to various sizes of ski boots. Thus, since the heel holder engages the cross bar through which a torque is created, which effects the engagement of the locking tooth with the teeth, any undesired adjustment of the slide member is avoided.

A preferred embodiment of the invention is characterized by the slide member being loaded by a spring, which holds the slide member in position in unloaded condition. In this manner, movement of the slide member is prevented when same is not engaged by the ski boot.

A further characteristic exists in the teeth, as is already known, being mounted on the upper surface of the sole plate and the upper cross bar having the locking tooth. This construction has the advantage that the locking part can easily be cleaned of ice or snow or the like.

A further thought of the invention consists in that the teeth are divided onto two side areas of the sole plate and each of these engages a locking tooth of the slide member. This construction is favorable for manufacturing reasons, and such symmetrical form is also advantageous in use.

BRIEF DESCRIPTION OF THE DRAWINGS

Further advantages and details of the invention will be discussed in connection with the drawings, which show two exemplary embodiments.

In the drawings:

FIGS. 2 and 3 are associated views of a first exemplary embodiment of the inventive adjusting mechanism, wherein FIG. 2 is a front view and FIG. 3 is a top view, FIGS. 5 and 6 are associated views of a second exemplary embodiment and FIG. 7 illustrates the adjusting mechanism of FIG. 5 in a tilted position.

DETAILED DESCRIPTION

Figure 1:
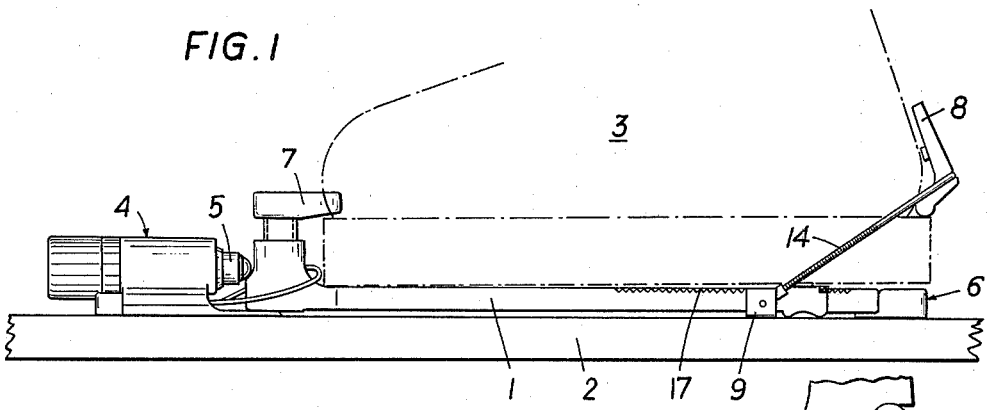
FIG. 1 is a front view of the arrangement of a sole plate on the ski.

As appearing in FIG. 1, a sole plate 1 which receives the indicated ski boot 3 is held on the ski 2. The sole plate is held in the front portion thereof by a holding mechanism 4 which has a spring-loaded locking pin 5 and in the rear portion thereof by a support mechanism 6. The sole of the ski boot 3 is gripped in the front by a support member 7 and in the rear by a heel holder 8. The heel holder 8 is suspended on a slide member 9 which can be adjusted in the longitudinal direction on the sole plate 1 and can be fixed thereon.

The sole plate can be released in a conventional manner either in the front or in the rear, both laterally and also upwardly. If for example a safety release occurs in the rear portion, then the rear end of the sole plate 1 slides out of the support mechanism 6 and the locking pin 5 of the front holding mechanism 4 moves forwardly against the force of the here not visible release spring by the forwardly moving sole plate 1.

Figure 2:
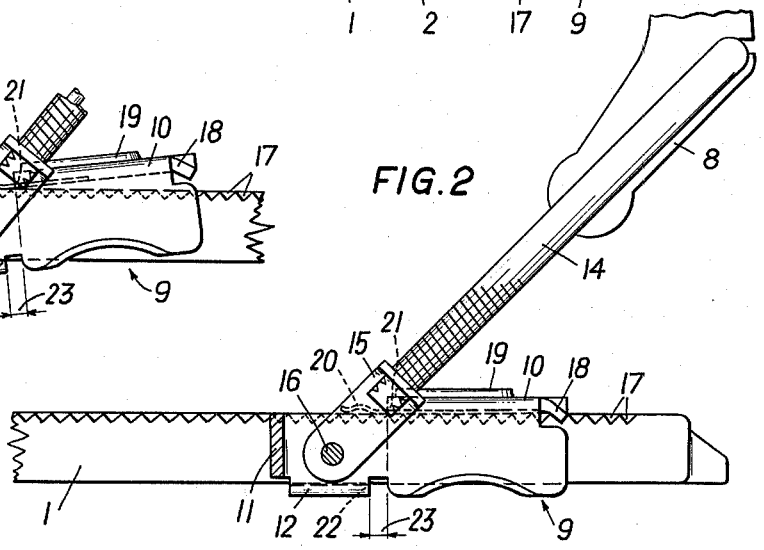
Figure 3:
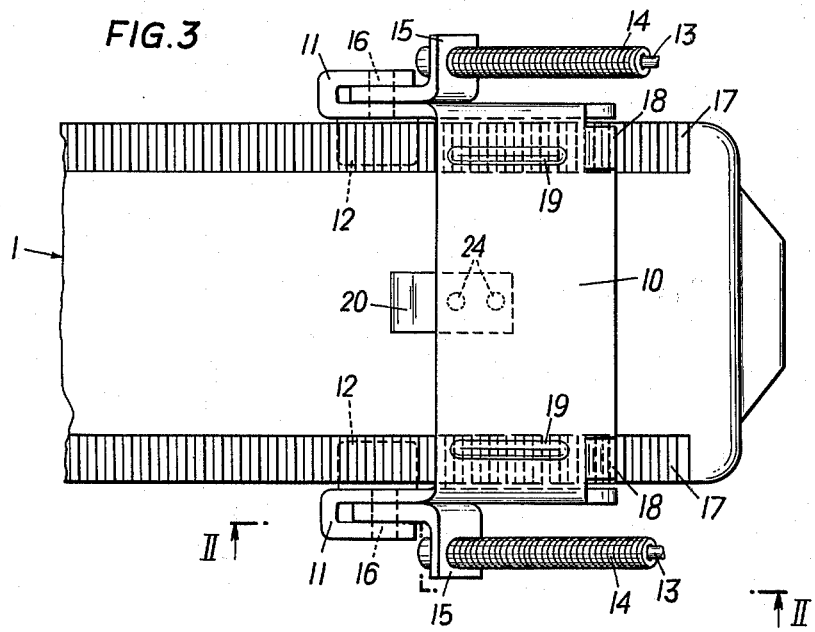

FIGS. 2 and 3 illustrate the special construction of the slide member 9 with its adjusting means. The slide member 9 has a substantially U-shaped upper cross bar 10 and two lateral cross bars 12, wherein the latter have backwardly bent, lateral ears 11 for each one cable 13 of the heel holder 8. The cable 13 is surrounded by Bowden wires 14, which are supported on a holding member 15 held in the ears by means of a pin 16. The two side areas of the release plate 1 have teeth 17, with which each locking tooth 18 of the upper cross bar 10 can engage. In the area of the teeth 17, the upper cross bar 10 has ribs 19 for the lateral stabilization of the ski boot 3.

As already mentioned, the lower cross bars 12 grip under the sole plate 1, so that the cable 13 in clamped position of the ski boot 3 urges the slide member 9 with the locking teeth 18 into the teeth 17. This holds the slide member 9 stable on the sole plate in clamped condition. If the heel holder 8 is out of engagement, then the slide member 9 can possibly shift on the sole plate 1, 2. To prevent this, a retaining spring 20 is provided which of course must produce only sufficient force that the slide member 9 and the heel holder 8 with the associated parts are held in position.

Figure 4:
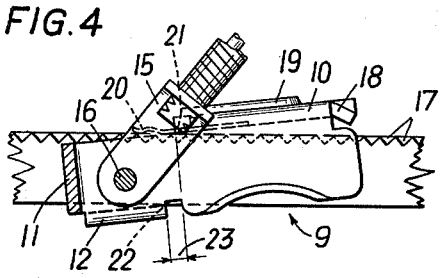
FIG. 4 is a partial front view of FIG. 2 with a tilted adjusting mechanism.

The bars 12 which grip under the sole plate 1 each have a rear edge 22, about which the slide member 9 can be tilted for adjustment. As is shown in FIG. 4, the locking tooth 18 of the upper cross bar 10 is thereby disengaged from the teeth 17 because the front edge 21 of the upper cross bar 10 forms an axis of rotation for the upper cross bar 10. In order to be able to carry out the tilting movement, a gap 23 is provided between the rear edge 22 of the lower bar 12 and the front edge 21 of the upper cross bar 10. The width of the gap — assuming a corresponding dimension of width and height of the slide member 9 — must be slightly larger than the height of the tooth of the locking tooth 18 or of the teeth 17. If the width of the slide member 9 is greater than its height, which is generally the case, then a gap 23 may be chosen which in relationship is smaller in order to still carry out the tilting operation. Such features will be apparent to the man skilled in the art and therefore do not need to be discussed.

The spring 20 is a leaf spring sliding on the surface of the sole plate 1 and is secured by means of rivets 24 in the upper cross bar 10.

In the exemplary embodiment shown in FIGS. 5 to 7, corresponding parts are identified as in FIGS. 2 to 4. In this exemplary embodiment teeth 17' are arranged in the lower part of the sole plate 1 but are otherwise the same as in the two side areas of the sole plate 1 in the earlier described exemplary embodiment. To assure the engagement also in this case, the upper cross bar 10 is offset forwardly in relationship to the cable 13, whereby the cable is supported in the holding part 15 which is provided in the rear area of the slide member 9. In this exemplary embodiment, the spring 20 which holds the slide member and the associated parts in position can be particularly well recognized.

The tilting according to FIG. 7 to adjust the slide member 9 is easily understandable in view of the explanation given in connection with FIG. 4.

The invention is not limited to the given exemplary embodiments. Various possibilities of construction are conceivable, which lie within the scope of the invention. For example the lower cross bar may also extend all of the way across the ski or the teeth may be provided in the central area of the slide member, in which case a locking tooth on the upper cross bar 10 will engage the teeth 17.

Also the cable may be differently secured on the slide member, for example so that the holding part is fixedly connected with the slide member. In this case the ears 11 and locking bolts 16 are not needed, however in such case the position of the cable may not always correspond to the calculated pull direction.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed as follows:

1. A safety ski binding, comprising:

a sole plate and releasable securement means for securing said sole plate to a ski;

spaced first locking means on said sole plate;

toe engaging means mounted on said sole plate for engaging and holding a toe of a ski boot to said ski;

movable heel engaging means movably mounted in a longitudinal direction on said sole plate for movement toward and away from said toe engaging means and for engaging and holding a heel of said ski boot to said sole plate, said heel engaging means including a carriage having vertically and fixedly spaced first and second slide members slidingly engaging vertically spaced surfaces on said sole plate and on opposite lateral sides thereof, one of said first and second slide members having second locking means thereon engaging said spaced first locking means on said sole plate to fixedly locate said movable heel holding means in a desired location on said sole plate; and means defining a longitudinal extending gap between an edge of said first slide member remote from said toe engaging means and an edge of said second slide member opposing said toe engaging means to facilitate a simultaneous rocking of said first and second slide members about a horizontal axis traverse of said sole plate to move said second locking means out of engagement with said first locking means and a longitudinal movement of said heel engaging means relative to said sole plate.

2. A safety ski binding according to claim 1, including resilient means for urging said carriage and said second locking means thereon into engagement with said first locking means on said sole plate.

3. A safety ski binding according to claim 1, wherein said first locking means comprises a plurality of teeth mounted on the upper surface of said sole plate and wherein said second locking means comprises at least one tooth on the upper one of said slide members.

4. A safety ski binding according to claim 3, wherein said first locking means comprises a pair of rows each having a plurality of teeth therein; and wherein said upper one of said slide members has a pair of teeth, each tooth overlying one of the rows of teeth and engaging said teeth therein.

5. In a safety ski binding having a sole plate which is releasably securable on a ski between holding members, said sole plate adapted for securement by a front portion thereof over a ski boot and including a heel holder engageable with the heel of such ski boot, said heel holder being adjustable longitudinally of the sole plate, the improvement comprising a slide member having at least two transverse members, which members rest respectively on the upper and lower surfaces of the sole plate, tooth means on said sole plate, one of said transverse members having tooth means engageable with said tooth means on said sole plate, said transverse members being longitudinally spaced from each other to facilitate a tilting of said transverse members relative to said sole plate and means connecting said heel holder to said slide member at such point thereon that the reaction force exerted when same is in use constantly urges the tooth portion of said slide member into firm engagement with the tooth portion of said sole plate, whereby said slide member is held firmly in position when in use but can be readily tilted for adjustment upon removal of the heel holder from the ski boot.

* * * * *